US008884760B2

(12) United States Patent
Zenisek et al.

(10) Patent No.: US 8,884,760 B2
(45) Date of Patent: Nov. 11, 2014

(54) CONTROL SYSTEM FOR MINE VENTILATION DOOR

(71) Applicant: American Mine Door Co., Cleveland, OH (US)

(72) Inventors: Daniel S. Zenisek, Medina, OH (US); Robert H. Chorman, Chardon, OH (US)

(73) Assignee: American Mine Door Co., Cleveland, OH (US)

( * ) Notice: Subject to any disclaimer, the term of this patent is extended or adjusted under 35 U.S.C. 154(b) by 94 days.

(21) Appl. No.: 13/774,479

(22) Filed: Feb. 22, 2013

(65) Prior Publication Data

US 2014/0022077 A1 Jan. 23, 2014

Related U.S. Application Data

(60) Provisional application No. 61/674,046, filed on Jul. 20, 2012, provisional application No. 61/674,007, filed on Jul. 20, 2012, provisional application No. 61/674,088, filed on Jul. 20, 2012.

(51) Int. Cl.

| | |
|---|---|
| ***G08B 13/08*** | (2006.01) |
| ***E05F 15/12*** | (2006.01) |
| ***E05F 17/00*** | (2006.01) |
| ***E21F 1/10*** | (2006.01) |
| ***E06B 1/52*** | (2006.01) |
| *E05F 15/20* | (2006.01) |
| *E05F 15/00* | (2006.01) |

(52) U.S. Cl.

CPC ..... *E21F 1/10* (2013.01); *E05F 15/127* (2013.01); *E05F 17/004* (2013.01); *E05F 2015/2053* (2013.01); *E05F 15/20* (2013.01); *E05F 15/2023* (2013.01); *E05Y 2201/62* (2013.01); *E05Y 2800/11* (2013.01); *E05F 15/2092* (2013.01); *E06B 1/52* (2013.01); *E05F 15/0004* (2013.01); *E05Y 2900/11* (2013.01); *E05F 2017/008* (2013.01)

USPC ..... 340/545.1; 340/3.1

(58) Field of Classification Search

CPC combination set(s) only.

See application file for complete search history.

(56) References Cited

U.S. PATENT DOCUMENTS

| | | | | |
|---|---|---|---|---|
| 5,222,838 | A * | 6/1993 | Kennedy et al. | 405/302 |
| 5,240,349 | A * | 8/1993 | Kennedy et al. | 405/132 |
| 6,425,820 | B1 * | 7/2002 | Kennedy et al. | 454/169 |
| 2011/0203182 | A1 * | 8/2011 | Kennedy et al. | 49/333 |

* cited by examiner

*Primary Examiner* — Travis Hunnings

(74) *Attorney, Agent, or Firm* — Richard M. Klein; Fay Sharpe LLP

(57) ABSTRACT

A mine door control system and method that uses sensor input from a plurality of sensors corresponding to at least one of a position of at least one associated opposing wing mine door and a path through the at least one associated mine door to determine at least one predefined action in accordance with received sensor input. A control command is then communicated a drive mechanism associated with the at least one associated mine door, the control command including instructions for operating the drive mechanism in accordance with the at least one predefined action.

22 Claims, 9 Drawing Sheets

CONTROL SYSTEM FOR MINE VENTILATION DOOR

CROSS-REFERENCE TO RELATED APPLICATIONS

This application claims priority to U.S. Provisional Application Ser. No. 61/674,046, filed Jul. 20, 2012 and entitled CONTROL SYSTEM FOR MINE VENTILATION DOOR, U.S. Provisional Application Ser. No. 61/674,007, filed Jul. 20, 2012 and entitled ROBUST MINE VENTILATION DOOR WITH SINGLE ACTUATION SYSTEM, and U.S. Provisional Application Ser. No. 61/674,088, filed Jul. 20, 2012 and entitled MINE VENTILATION DOOR WITH WINGS AND SLIDABLE OR POCKET PERSONNEL DOOR, the entirety of which are incorporated by reference herein.

BACKGROUND

The present disclosure presents a control system for mine ventilation doors, and particularly, a system and method for controlling the operations of opposing wing mine ventilation doors in high and low pressure environments.

Prior to the introduction of automated mine doors, mine operators used "snappers" to open and close doors on the haulage road, so that the motorman would not have to stop. The snapper would open the door, wait for the last car to pass, close the door and then run to get back on the train/tram for the remainder of the trip. In practice, however, often times the motorman would not stop, he would only slow down so that snapper could run ahead of the locomotive and open door. This practice proved unsafe for the miners, the motorman, and detrimental to both the locomotive and the doors.

The advent of machine-assisted mine doors helped alleviate some of the dangers; however such doors still required manual engagement of the machines to open and close the doors. Furthermore, the pressures being exerted on these doors also increased, as ventilation became more effective and powerful due to increases in operating temperatures, depths, mine size, etc. As mines reach greater depths, the size of the doors must increase to accommodate larger and larger equipment, i.e., the easily accessible minerals have already been retrieved, leaving the harder to access deposits farther underground. The increase in size has led accordingly to increases in the power, both applied and consumed, in opening and closing these doors.

The typical mine door includes two wings, which either swing inward or outward, depending upon the configuration. The strength, size, and functional machinery for proper function substantially increases in high-pressure environments. Thus, when either opening or closing, the pressure provides assistance. However, this standard design is hindered in the reverse operation, wherein not only the mass of the doors must be moved, but also the opposing the flow of air must be overcome to properly close the mine doors. As will be appreciated, such standard design is notably hindered in speed of operation as a result of the wings of the door both swinging either inward or outward, as well as negatively impacted by the air pressure, which only helps either open or close and hindering the opposite.

Accordingly, what is needed is a control system for a mine door to provide economical, safe, efficient, durable, and practical ventilation control for all types of track and trackless mines, including, e.g., coal, uranium, salt, gypsum, clay, gold, potash, titanium, copper, molybdenum, platinum, etc.

BRIEF DESCRIPTION

One aspect of the present disclosure discussed herein is drawn to a mine door control system. The mine door control system includes a processor and a sensor analysis component in communication with the processor, the sensor analysis component configured to receive sensor data from a plurality of sensors corresponding to operation of the at least one associated mine door. The mine door control system further includes memory that is in communication with the processor. The memory stores instructions which are executed by the processor for receiving sensor input from the plurality of sensors corresponding to at least one of a position of the at least one associated mine door and a path through the at least one associated mine door. The instructions are also for determining a predefined action in accordance with received sensor input. In addition, the instructions include operating at least one drive mechanism associated with the at least one associated mine door in accordance with the determined predefined action responsive to the received sensor input.

In another aspect, the present disclosure includes a method for controlling a mine door. The method includes receiving sensor input from a plurality of sensors corresponding to at least one of a position of the at least one associated mine door and a path through the at least one associated mine door. The method also includes determining, with a processor, at least one predefined action in accordance with received sensor input. Additionally, the method includes communicating a control command to a drive mechanism associated with the at least one associated mine door, the control command including instructions for operating the drive mechanism in accordance with the at least one predefined action. The method also includes receiving sensor data from the plurality of sensors responsive to the performance of the at least one predefined action.

In one aspect, a mine door control system includes a processor and memory in communication with the processor. The system also includes at least one drive mechanism configured to open and close at least one associated mine door, and a plurality of sensors configured to provide input to the processor corresponding to operation of the at least one associated mine door. The memory of the system stores instructions which are executed by the processor for receiving sensor input from the plurality of sensors corresponding to at least one of a position of the mine door; and operating the at least one drive mechanism in accordance with received sensor input.

BRIEF DESCRIPTION OF THE FIGURES

The following is a brief description of the drawings, which are presented for the purposes of illustrating exemplary embodiments disclosed herein and not for the purposes of limiting the same.

DESCRIPTION

Figure 1A:
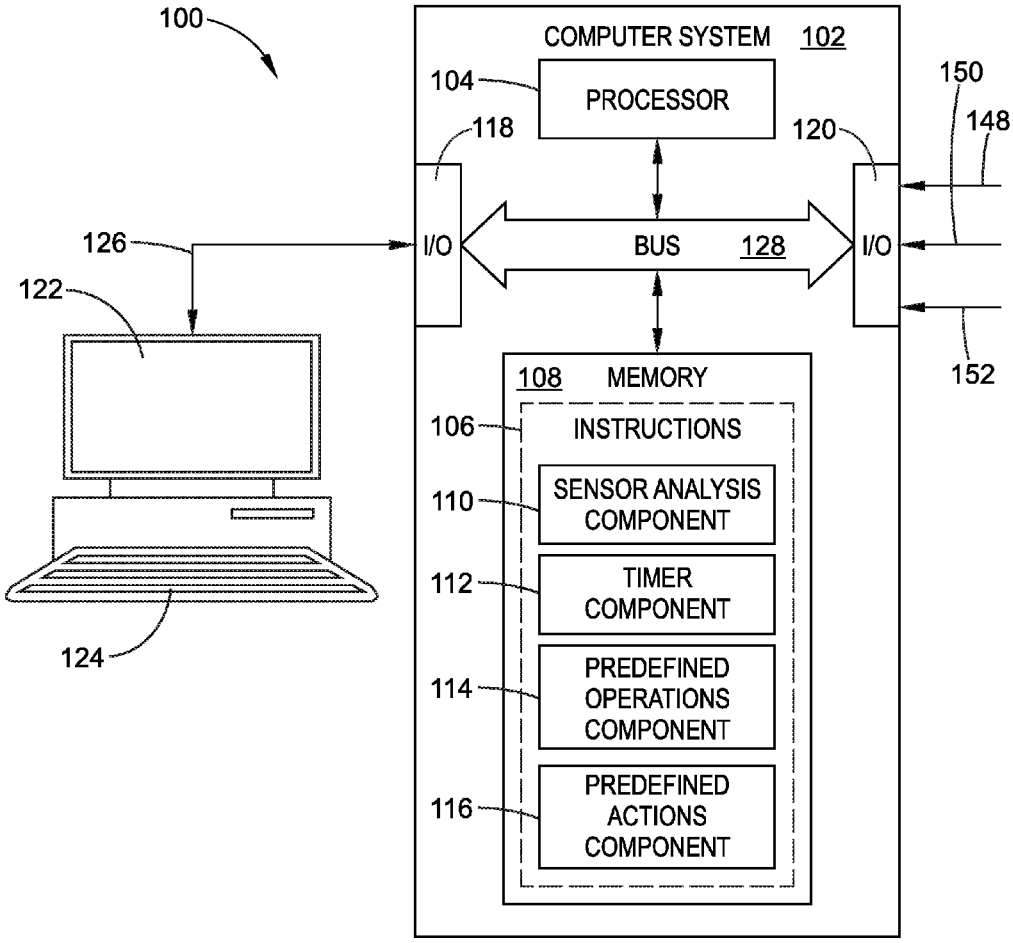
FIGS. 1A-1B are a functional block diagram of a mine door control system in accordance with one embodiment of the present disclosure.

One or more implementations of the subject application will now be described with reference to the attached drawings, wherein like reference numerals are used to refer to like elements throughout.

Figure 1B:
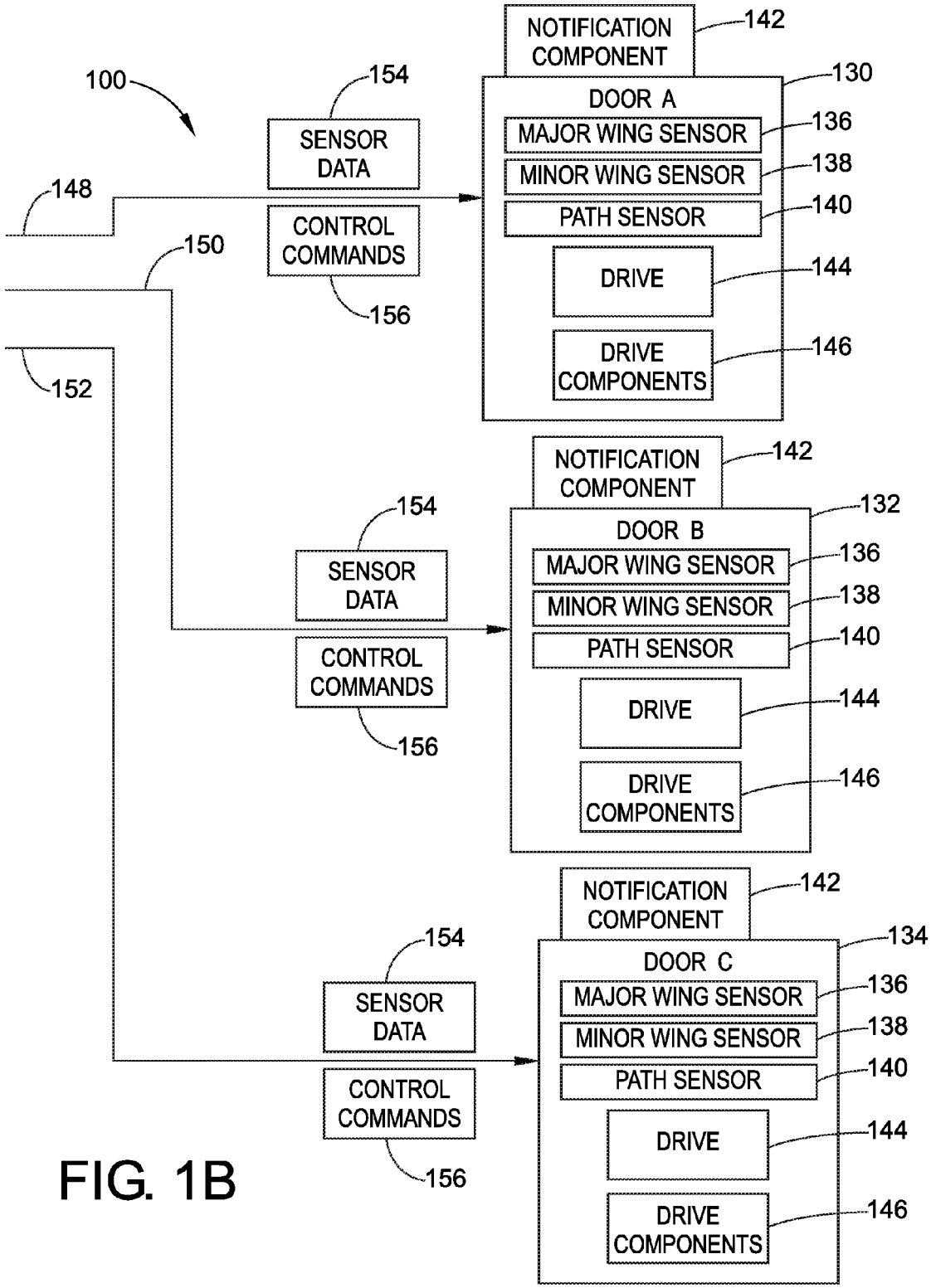

Referring now to FIGS. 1A-1B, there is shown a system 100 capable of controlling one or more mine doors 130-134. Such mine doors 130-134 may be operated in pairs, individually, or combinations of multiple doors. The mine doors 130-134 may be opposing wing doors, wherein the major wing and minor wings open in opposing directions, single doors, standard doors, or the like. In the embodiment discussed hereinafter, reference is made to an opposing wing door, however other implementations are capable of utilizing the control system 100 of the present disclosure. It will be appreciated that the various components depicted in FIGS. 1A-1B are for purposes of illustrating aspects of the exemplary embodiment, and that other similar components, implemented via hardware, software, or a combination thereof, are capable of being substituted therein.

It will be appreciated that the mine door control system 100 is capable of implementation using a distributed computing environment, such as a computer network, which is representative of any distributed communications system capable of enabling the exchange of data between two or more electronic devices. It will be further appreciated that such a computer network includes, for example and without limitation, a virtual local area network, a wide area network, a personal area network, a local area network, the Internet, an intranet, or the any suitable combination thereof. Accordingly, such a computer network comprises physical layers and transport layers, as illustrated by various conventional data transport mechanisms, such as, for example and without limitation, Token-Ring, Ethernet, or other wireless or wire-based data communication mechanisms. Furthermore, while depicted in FIGS. 1A-B as a networked set of components, the system and method are capable of implementation on a stand-alone device adapted to perform the methods described herein.

As shown in FIGS. 1A-1B, the mine door control system 100 includes a computer system 102, which is capable of implementing the exemplary method described below. The computer system 102 may include a computer server, workstation, personal computer, laptop computer, cellular telephone, tablet computer, pager, combination thereof, or other computing device capable of executing instructions for performing the exemplary method. In one embodiment, the computer system 102 corresponds to a programmable logic controller suitably configured in accordance with the methods described hereinafter.

According to one example embodiment, the computer system 102 includes hardware, software, and/or any suitable combination thereof, configured to interact with an associated user, a networked device, networked storage, remote devices, or the like. The exemplary computer system 102 includes a processor 104, which performs the exemplary method by execution of processing instructions 106 which are stored in memory 108 connected to the processor 104, as well as controlling the overall operation of the computer system 102.

The instructions 106 include a sensor analyzer component 110 that is configured to analyze sensor data 154 received from each door 130-134, as discussed below. The sensor analyzer component 110 may be hardware, software, or a combination thereof, implemented as a process by the processor 104 or other component of the computer system 102. Other functions of the sensor analyzer component 110 will be better understood in conjunction with FIG. 4.

The instructions 106 may also include a timer component 112 that is configured to operate to time certain operations, e.g., opening/closing of the doors 130-134, transit through the doors 130-134, inputs received from various sensors 136-140, operation of drives 142, drive components 144, duration of actions/activations, times between inputs, and the like. Other functions of the timer component 112 will be better understood in conjunction with FIG. 4.

The instructions may further include a predefined operations component 114 that may be configured to store or direct the processor 104 to execute certain predefined operations with respect to the mine doors 130-134, e.g., air-lock transit, transfer of personnel, transfer of ore, etc. The instructions may also include a predetermined action component 116 that may be configured to store or direct the processor 104 to execute certain predefined actions in response to input received from the sensors 136-140, e.g., stop drive operations, halt door opening/closing, etc. Other functions of the components 110-116 will be better understood in conjunction with FIG. 4.

The memory 108 may represent any type of non-transitory computer readable medium such as random access memory (RAM), read only memory (ROM), magnetic disk or tape, optical disk, flash memory, or holographic memory. In one embodiment, the memory 108 comprises a combination of random access memory and read only memory. In some embodiments, the processor 104 and memory 108 may be combined in a single chip. The network interface(s) 120, 122 allow the computer to communicate with other devices via a computer network, and may comprise a modulator/demodulator (MODEM). Memory 108 may store data the processed in the method as well as the instructions for performing the exemplary method.

The digital processor 104 can be variously embodied, such as by a single core processor, a dual core processor (or more generally by a multiple core processor), a digital processor and cooperating math coprocessor, a digital controller, or the like. The digital processor 104, in addition to controlling the operation of the computer 102, executes instructions 106 stored in memory 108 for performing the method outlined in FIG. 4.

The term "software," as used herein, is intended to encompass any collection or set of instructions executable by a computer or other digital system so as to configure the computer or other digital system to perform the task that is the intent of the software. The term "software" as used herein is intended to encompass such instructions stored in storage medium such as RAM, a hard disk, optical disk, or so forth, and is also intended to encompass so-called "firmware" that is software stored on a ROM or so forth. Such software may be organized in various ways, and may include software components organized as libraries, Internet-based programs stored on a remote server or so forth, source code, interpretive code, object code, directly executable code, and so forth. It is contemplated that the software may invoke system-level code or calls to other software residing on a server or other location to perform certain functions.

The computer system 102 also includes one or more input/output (I/O) interface devices 118 and 120 for communicating with external devices. The I/O interface 118 may communicate with one or more of a display device 122, for displaying information, and a user input device 124, such as a keyboard or touch or writable screen, for inputting text, and/or a cursor control device, such as mouse, trackball, or the like, via a communication link 126 so as to communicating user input information and command selections to the processor 104. The various components of the computer system 102 may all be connected by a data/control bus 128. While illustrated as a display device 122, the display may be simple lights or auditory alerts associated with the operations of the control system 100, indicative of some action with respect to the doors 130-134, or the like. Similarly, the user input device 124 may correspond to lighted buttons, pull cords, switches, or other operative inputs associated with operations of the control system 100 with respect to the doors 130-134.

Each door, i.e., door A 130, door B 132, and door C 134 includes a major wing position sensor 136, a minor wing position sensor 138, a path sensor 140, a notification component 142 (e.g., lights, speakers, etc.), a drive mechanism 144, and drive components 146 (e.g., solenoids, motor controllers, pumps, etc.). The doors are in communication with the computer system 102 via the I/O 120 using the communication links 148-152. A suitable communications link 148-152 may include, for example, the public switched telephone network, a proprietary communications network, infrared, optical, or other suitable wired or wireless data transmission communications. The wing sensors 136-138 may be limit switches, infrared sensors, laser-based sensors, sonic sensors, airflow sensors, speed sensors, magnetic-based sensors, and the like. The path sensor 140 may include a light-beam sensor, magnetic-based sensor, pressure-based sensor, or the like. The notification component 142 may include, for example, a speaker for broadcasting various warnings, alerts, sirens, sounds, messages, etc., corresponding to the action being performed by the door 130-134 or output of sensors 136-140. The notification component 142 may also include a visual indicator, e.g., lights (continuous, flashing, or otherwise), lights of different colors, etc. Other types of notifications may also be used herein, e.g., radio broadcast, etc.

The sensor data 154 may be communicated to computer system 102 via the communication links 148-152. Using the communication links 148-152, control commands 156 may be sent from the computer system 102 to the drive components 146 so as to operate the drives 144 in accordance with predetermine operations 114, predetermined actions 116, user input commands via 124, or the like.

Figures 2A, 2B, 2C, 2D:
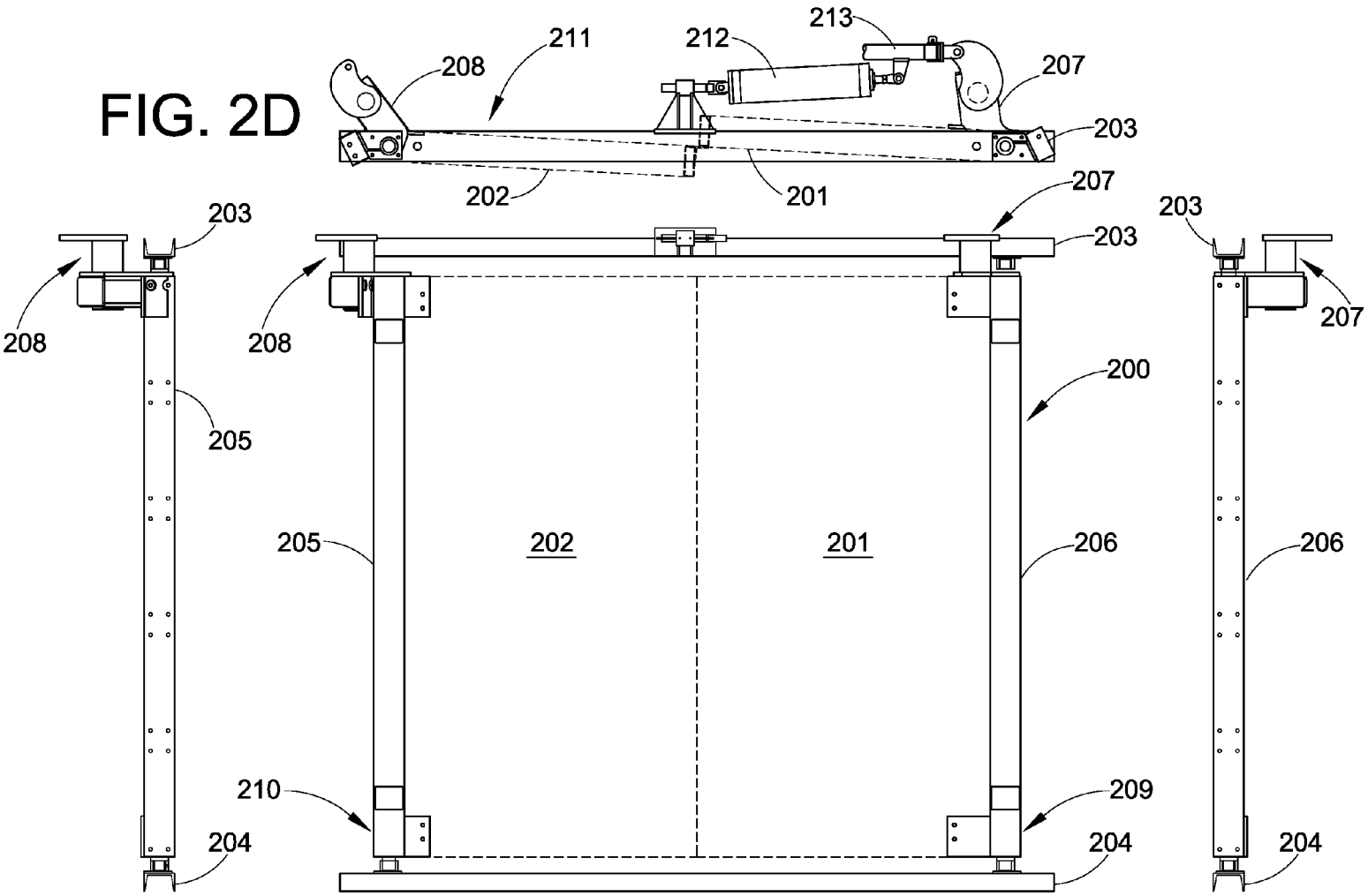
FIG. 2A illustrates a front view of a schematic representation of a high-pressure door assembly in accordance with one embodiment of the present disclosure.
FIG. 2B illustrates a side view of the minor wing of the schematic representation of a high-pressure door assembly in accordance with one embodiment of the present disclosure.
FIG. 2C illustrates a side view of the major wing of the schematic representation of a high-pressure door assembly in accordance with one embodiment of the present disclosure.
FIG. 2D illustrates a top view of the schematic representation of a high-pressure door assembly in accordance with one embodiment of the present disclosure.
Figure 2E:
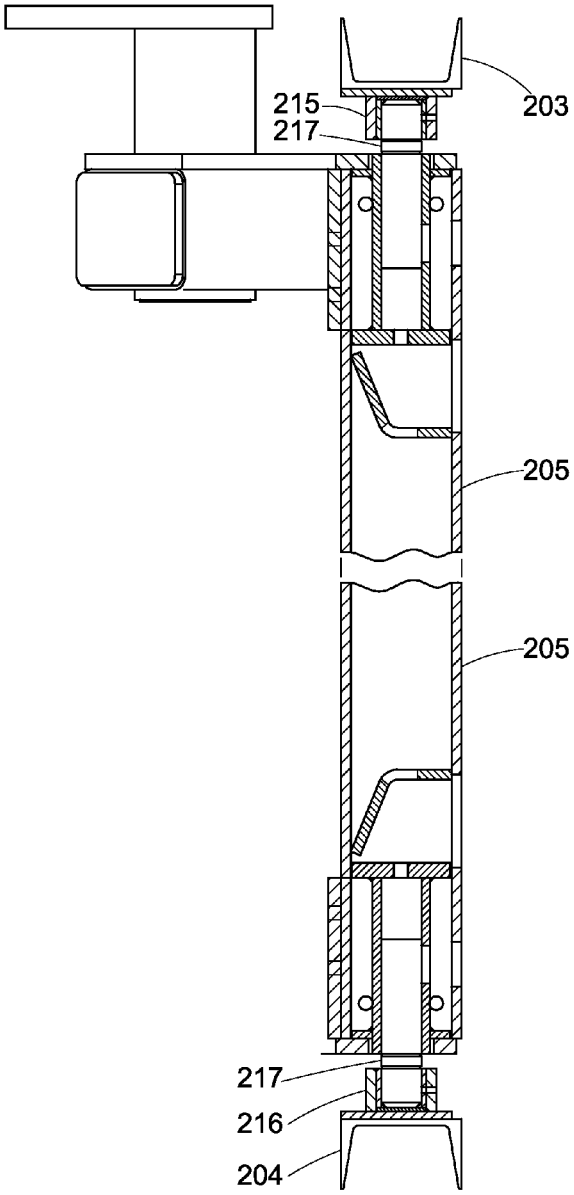
FIG. 2E illustrates a first side view of top and bottom portions of the minor wing hub and bearing for a high-pressure door assembly in accordance with one embodiment of the present disclosure.
Figure 2F:
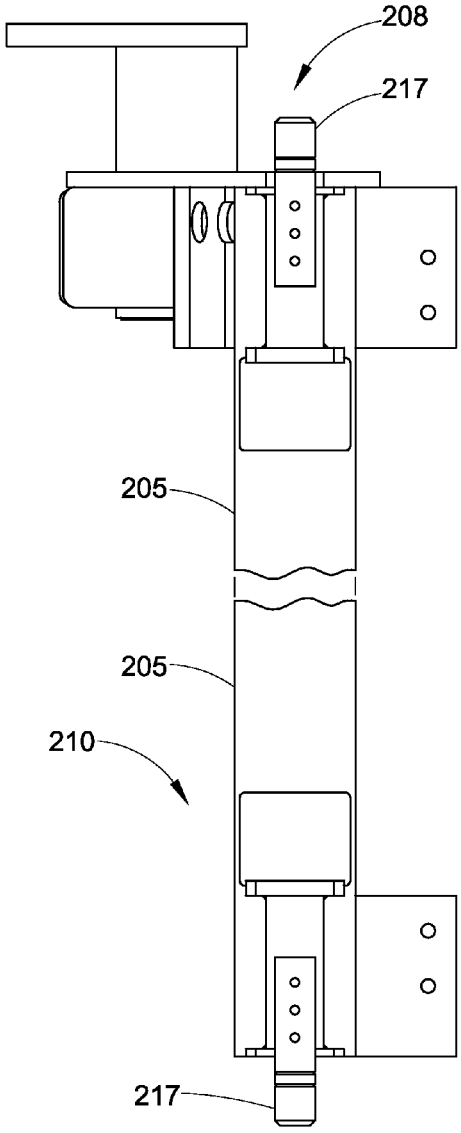
FIG. 2F illustrates a second side view of top and bottom portions of the minor wing hub and bearing for a high-pressure door assembly in accordance with one embodiment of the present disclosure.
Figure 2G:
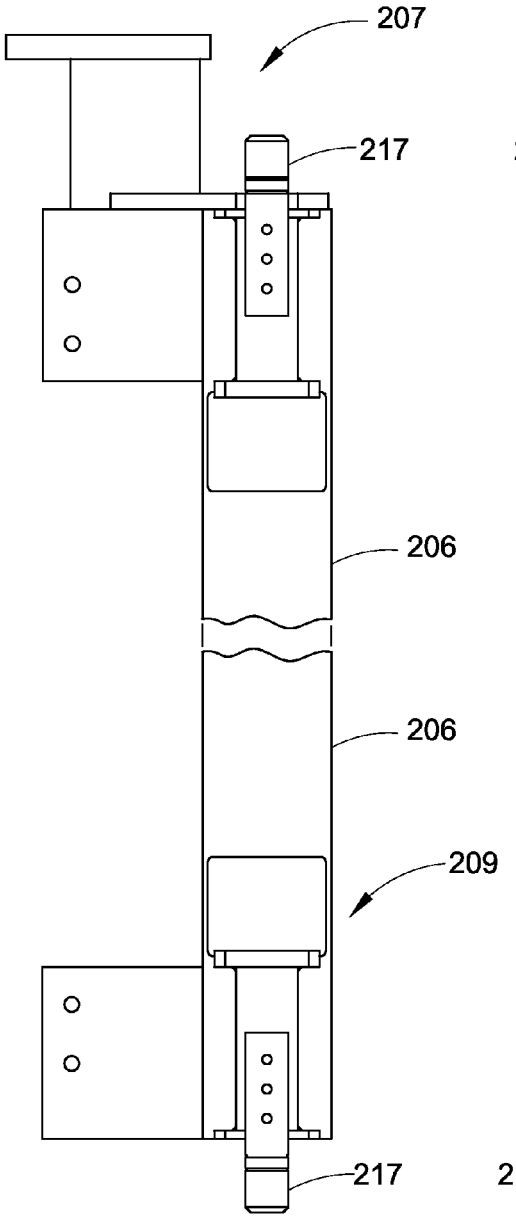
FIG. 2G illustrates a first side view of top and bottom portions of the major wing hub and bearing for a high-pressure door assembly in accordance with one embodiment of the present disclosure.
Figure 2H:
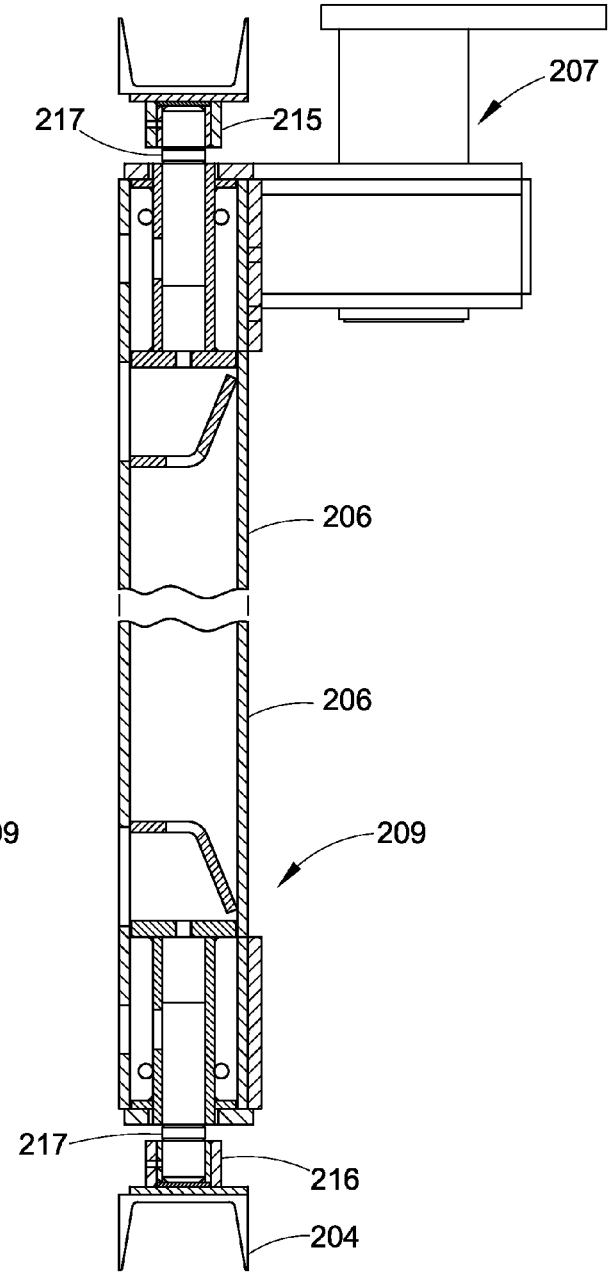
FIG. 2H illustrates a second side view of top and bottom portions of the minor wing hub and bearing for a high-pressure door assembly in accordance with one embodiment of the present disclosure.

A suitable example of a mine door 130-134 is illustrated in FIGS. 2A-3C. FIGS. 2A-2H and 3A-3C depict several illustrations of the various components of a high-pressure mine door assembly and installation in accordance with one embodiment of the present disclosure. FIG. 2A depicts a front view of the mine door assembly 200 including a major wing 201, a minor wing 202, and frame components cap 203, sill 204, a first post 205 (shown in FIG. 2B) and a second post 206 (shown in FIG. 2C).

Also illustrated in FIGS. 2A-2C are the major hub 207, the minor hub 208, major sill bearing assembly 209, and the minor sill bearing assembly 210. As illustrated in FIGS. 2A-2H, the cap 203 includes bearings 215 operative to receive pins 217 extending upward from the wings 201-202 so as to enable the rotation of the wings 201-202 with respect to the stationary cap 203 (shown in FIG. 2D). Similarly, the sill 204 includes bearings 216 (i.e., portions of the sill bearing assemblies 209-210) operative to receive pins 217 extending downward from the wings 201-202 so as to enable the rotation of the wings 201-202 with respect to the stationary sill 204. In some embodiments, hardened pins 217 and bronze or other durable materials may be used in the bearings 215-216.

The wings 201-202 may further include seals, gaskets, or the like, to prevent airflow from circumventing the door assembly 200. Expanded views of these components are also illustrated in FIGS. 2E-2H as shown. A top view 211 is presented in FIG. 2D illustrating the connection of a drive mechanism 212 to the cap 203 and the major hub 207 and minor hub 208, the major and minor wings 201-202 being connected via the connecting bar 213 that is engaged by the drive mechanism 212 to open and close the wings 201-202. As illustrated in the subsequent figures, the connecting bar 213 is moveably coupled to the major hub 207 and the minor hub 208. The drive mechanism 212 may be any suitable mechanism for opening and closing the wings 201-202 including, for example, hydraulic, pneumatic, manual, electronic, or the like. The drive mechanism 212 may include cushions so as to allow for faster cycling of the door assembly 200, e.g., located at opposing ends of a hydraulic or pneumatic driven cylindrical actuator. When implemented, the cushion effect provided by such cushions may affect a portion of the stroke of the cylindrical actuator, e.g., 2 inches, 4 inches, or the like, depending on the length of the stroke, the size of the door, etc. It will be appreciated that such cushions may be adjustable and may be manipulated to achieve certain rates of cushioning, dependent upon the individual needs of the mine in which the doors are implemented. Accordingly, such cushions may increase door speed travel and prevent damage to the door assembly 200.

As depicted in FIG. 2D, a single drive mechanism 212 is advantageously used, one end coupled to the cap frame portion 203 and the drive portion coupled to the connecting bar 213. Upon engagement of the drive mechanism 212, the drive portion forces the connecting bar 213 to move, thereby opening the wings 201-202 of the door assembly 200. It will be appreciated that the configuration of the hubs 207 and 208, as illustrated by the feet thereof (discussed below) facilitate the fast opening and closing of the wings. Furthermore, placement of the drive mechanism 212 and connecting bar 213 parallel with or slightly above the bottom of the cap frame portion 203 prevents damage to the mechanism 212 and bar 213 by equipment transiting through the door assembly 200. The drive mechanism 212 may also be located midway between the cap frame portion 203 and the sill frame portion 204, with the corresponding connecting bar 213 operatively coupled at the cap portion 203 or frame portion 204 and the drive mechanism 212 to one of the major or minor wings 201-202.

Figure 3A:
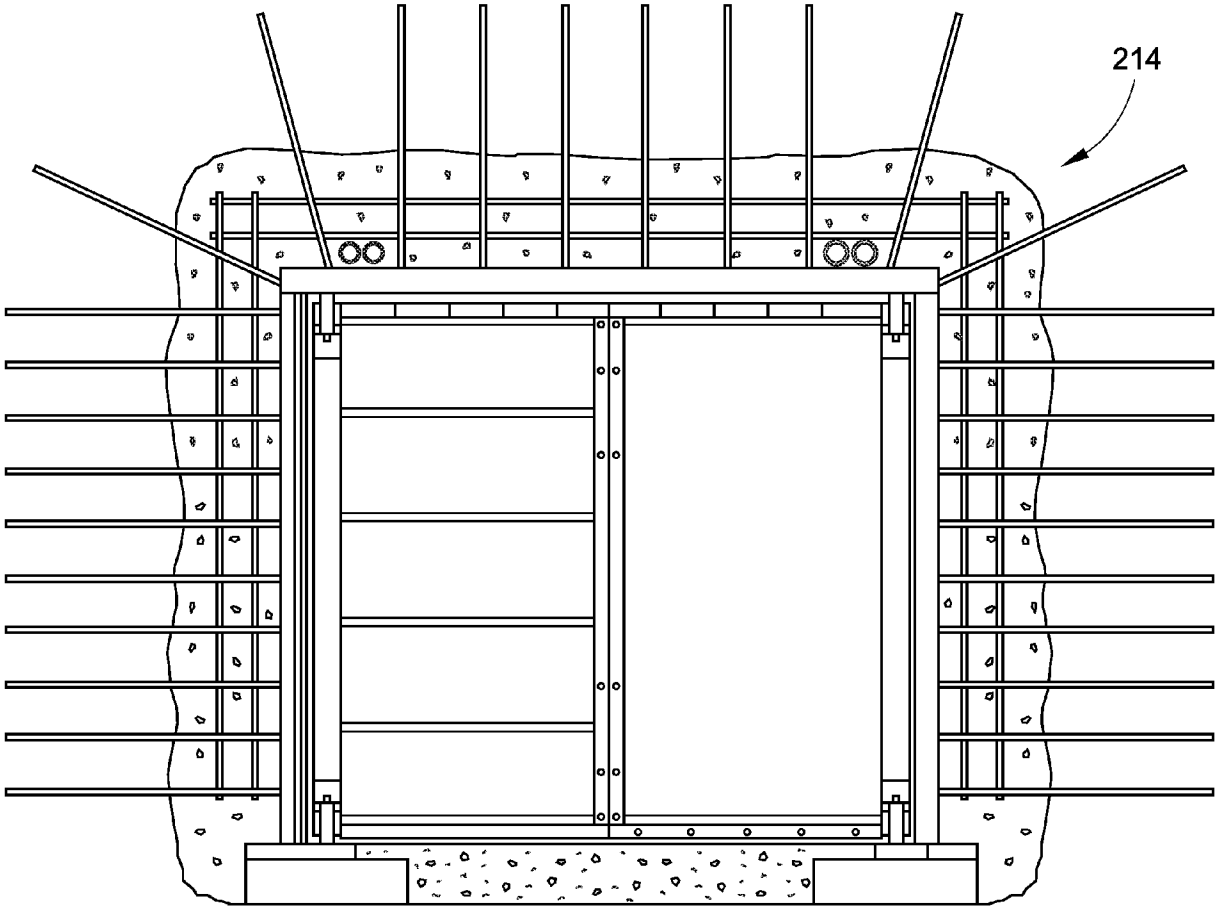
FIG. 3A illustrates a schematic representation of a high-pressure door assembly installation in accordance with one embodiment of the present disclosure.
Figure 3C:
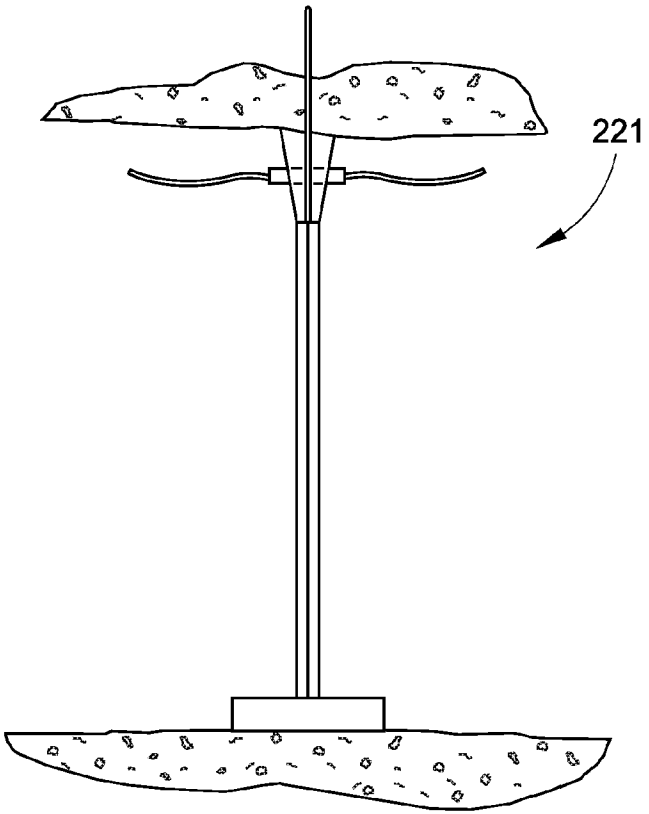
FIG. 3C illustrates a cross-sectional view of the schematic representation of a high-pressure door assembly installation in accordance with one embodiment of the present disclosure.
Figure 3B:
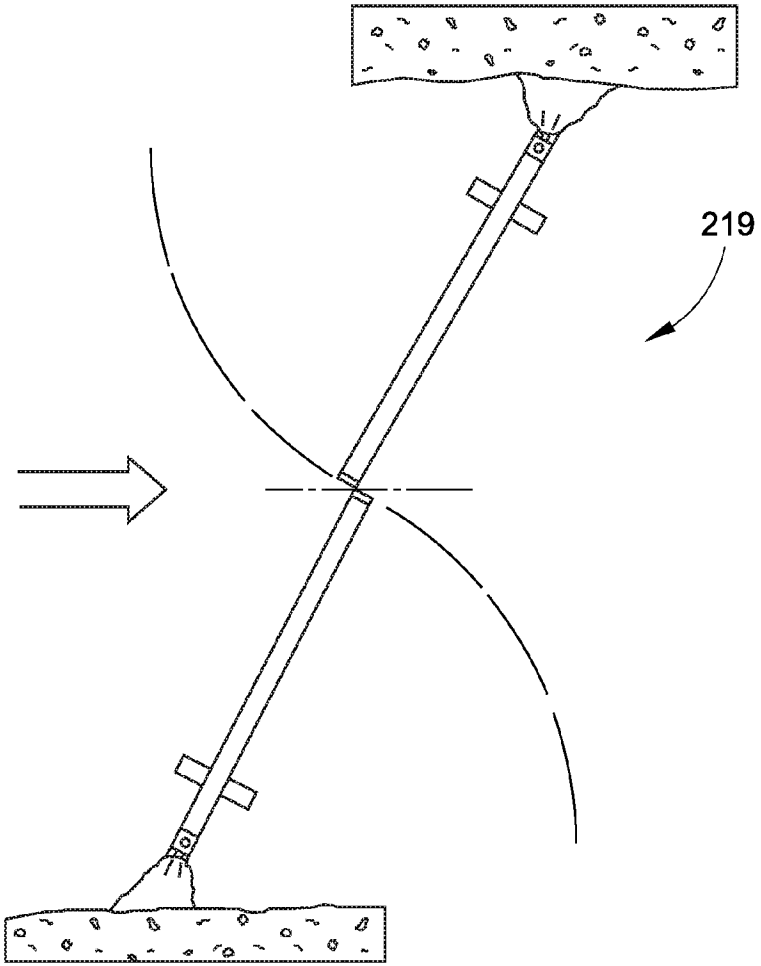
FIG. 3B illustrates a top view of the schematic representation of a high-pressure door assembly installation in accordance with one embodiment of the present disclosure.

FIGS. 3A-3C illustrate various views of an installation of the mine door assembly 200. FIG. 3A depicts a front view of the installation 214, illustrating the securing of the cap 203, sill 204, and sides of the mine door assembly 200 to the surrounding ventilation/mine shaft. FIG. 3B is a side view 219 of the installation 214 shown in FIG. 3A depicting the slanted orientation of the assembly 200 to facilitate faster opening of the wings 201-202. FIG. 3C illustrates a cross-sectional view 221 of the installation 214, 219 of the mine door assembly 200 shown in FIGS. 3A-3B. The speed with which a mine door cycles open and closes has an impact on the overall operation of the mine, i.e., the speed with which equipment, personnel or ore may transit a mine shaft. Current implementations of mine doors may require 45-50 seconds to cycle open, with a corresponding time to cycle close. In contrast, the subject embodiments employ a cantilevered or offset implementation, wherein the wings 201-202 of the mine door 200 open from 9 to 16 seconds, in accordance with the size of the door. To achieve such speed, the wings 201-202 are positioned at a 12/6 pitch orientation, thereby reducing the distance required to open and close the wings 201-202. That is, each wing 201 and 202 need swing open two-thirds to allow full access to the shaft.

Pairs of such high-pressure door assemblies 200 may be emplaced in a mine shaft so as to facilitate the formation of an airlock there between. Such an airlock may be used to prevent outgassing or in gassing to unused portions of a mine, to prevent dust accumulation in non-working sites, to send air to the face of the mine (where current mining is occurring), to control the amount of airflow through the shaft, or the like. For example, a mine operator may want to restrict the flow of air to a certain portion of the mine, but may still need to get equipment through. In order to facilitate this traffic, the airlock is formed of a set of two or more door assemblies. One door will open while the other remains closed. Once the traffic has transited the open door, that door will close following which the next door opens. Previous mine doors made this a long and arduous process. In contrast, the orientation and design of the subject high-pressure mine door assembly 200 facilitates faster opening and closing, while also making such opening easier to accomplish due to the opposing wing design, i.e., one door wing comes forward and the other door wing goes backwards in synchronization via the connecting bar 213. Other types of mine door assemblies (not shown) may also be controlled by the system 100 depicted in FIGS. 1A-1B, and the present disclosure references the mine door assembly 200 of FIGS. 2A-3C for example purposes only.

Figure 4:
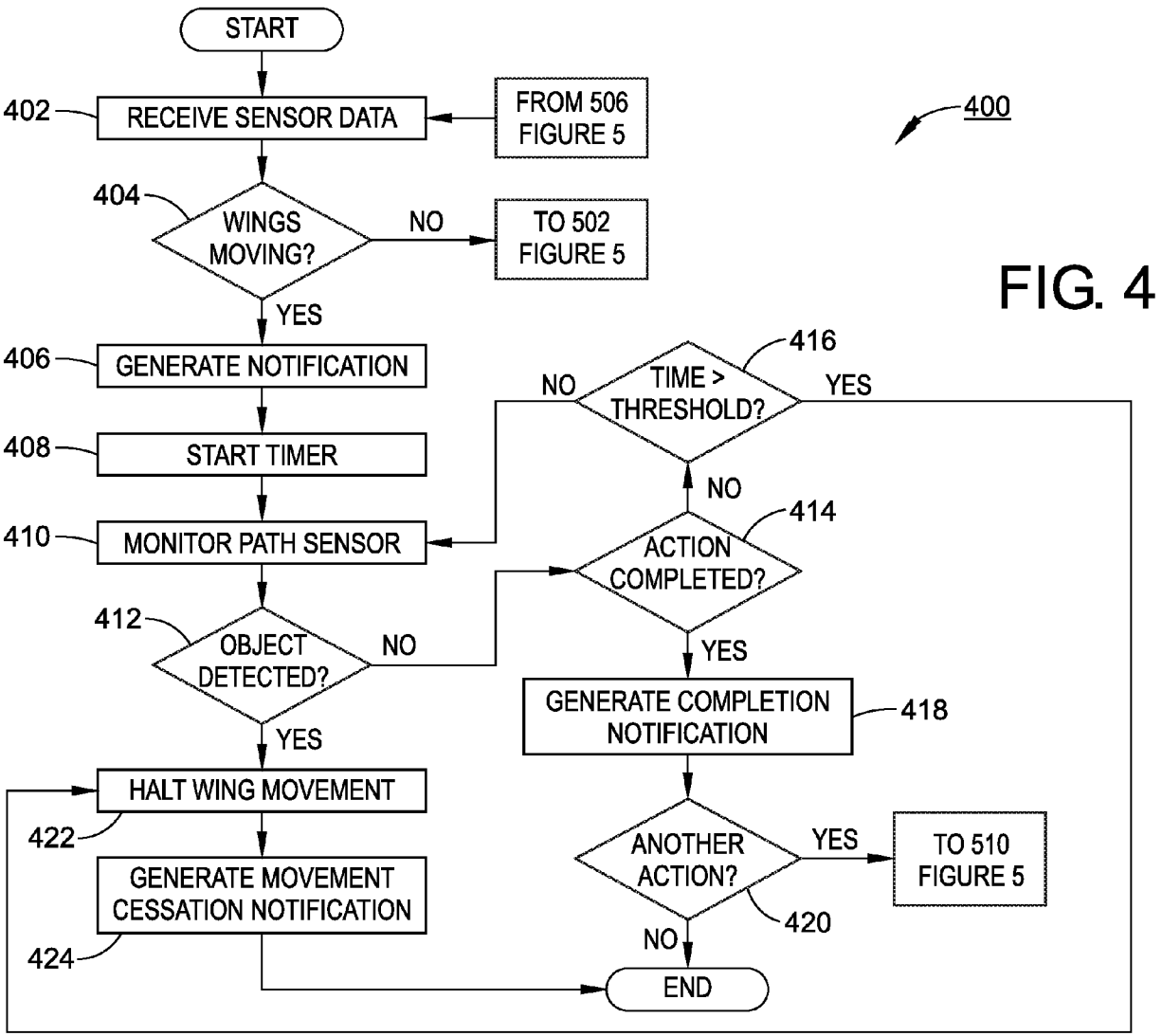
FIG. 4 illustrates a flowchart representation of an example method of operation of the mine control system in accordance with one embodiment of the present disclosure.
Figure 5:
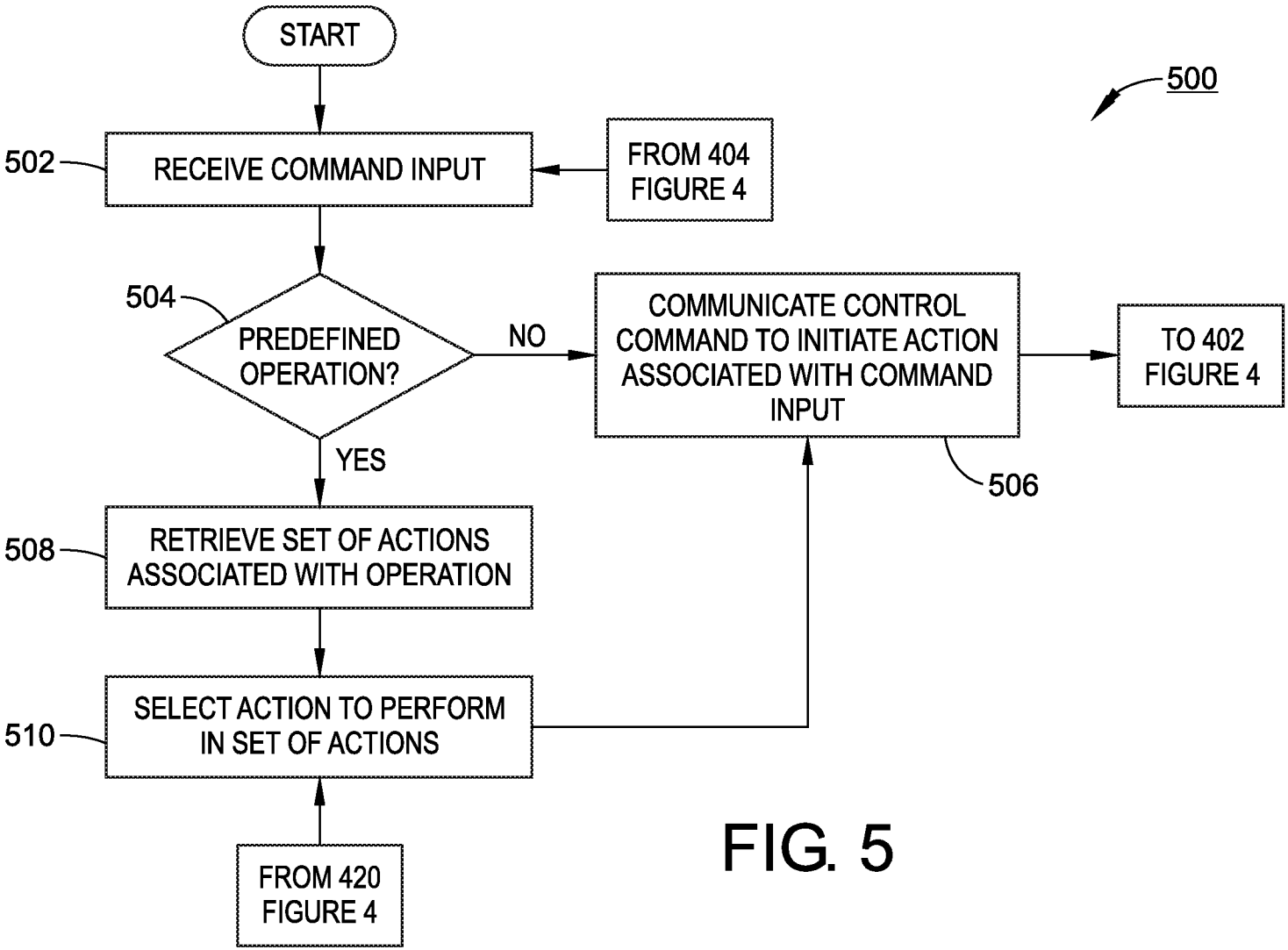
FIG. 5 illustrates a flowchart representation of an example method of operation of the mine control system in accordance with one embodiment of the present disclosure.

Turning now to FIG. 4, there is shown a flowchart 400 illustrating an operation of a mine door(s) 130-134 (shown in FIGS. 2A-2H as the mine door assembly 200) in accordance with the control system 100 of FIGS. 1A-1B. The example methodology begins at 402, whereupon sensor data 154 is received from the sensors 136-140 associated with each door 130-134. In some embodiments, sensor data 154 is received only from a single door 130, 132, or 134. For example purposes only, reference is made hereinafter to input and control of a single door. However, it will be appreciated that the method set forth in FIGS. 4-5 are adaptable to multi-door controls, e.g., operation of an air-lock, wherein all sensors 136-140 for each door are utilized in performing the actions of opening and closing the doors 130-134. In one embodiment, the sensors 136-140 may comprise a pair of sensors, e.g., sonic, infrared, etc., wherein the tripping of a first sensor (in either direction) directs the opening of the door assembly 200, and the tripping of a second sensor (located on an opposing side of the door assembly 200 and facing the opposite direction of the first sensor) directs the closing of the door assembly 200.

At 404, a determination is made by the sensor analysis component 110 based upon the sensor data 154 whether the wings 201-202 of a door 130-134 are moving. Upon a negative determination, operations proceed to 502 of FIG. 5 as discussed in greater detail below. Upon a positive determination at 404, operations proceed to 406, whereupon a notification is generated at the door 130-134 via the notification component 142 and at the computer system 102 via the output device 122 (in the event that the computer system 102 and the door 130-134 in operation are not co-located or in reasonable physical proximity). The notification component 142 may comprise a speaker for an audible alert, a light for flashing or illuminating a visual alert, or a combination thereof. The timer component 112 is then initiated to time the movement of the wings 201-202 of the door 130-134 at 408. At 410, the path sensor 140 is monitored by the sensor analysis component 110 to detect whether any obstruction is present in the path of the wings 201-202 as they are opening or closing.

A determination is then made whether an obstruction is detected via analysis of the path sensor 140 at 412. For example, whether a miner, vehicle, equipment, tram, train, or other object is in the path of the wings 201-202, is transiting the open doorway, etc. Upon a negative determination, operations proceed to 414, whereupon a determination is made whether the action (opening door, closing door, etc.) is complete. Upon a negative determination at 414, a determination is made at 416 whether the time (as indicated by the timer component 112) is greater than a predetermined threshold time associated with the action.

Upon a negative determination at 416, operations return to 410 for continuous monitoring of the path sensor 140. Upon a positive determination at 416, operations proceed to 422, whereupon the action currently being performed is halted, i.e., movement of the wings 201-202 so as not to hit the obstruction or damage the door 130-134. The notification component 142 then signals a movement cessation notification at 424, e.g., an audible or visual alert indicating a movement of the wings 201-202 has ceased. For example, some item of equipment or debris may be allowing the wings 201-202 to close, but at a slower rate than normal operations would indicate. The control system 100 may then halt operations of the wings 201-202 and indicate that something is wrong. It will be appreciated that the movement may thereafter commence should the problem be remedied.

Returning to 412, upon a determination that an obstruction is detected, operations proceed to 422, whereupon the movement of the wings 201-202 is halted and a movement cessation notification is generated at 424 as set forth above. Upon a determination at 412 that no objects are detected, and upon a determination that the action currently being performed is complete at 414, operations proceed to 418. At 418, a completion notification is generated via the notification component 142 indicating that the action (moving the wings 201-202) has been completed. Suitable notifications may include, for example and without limitation, an audible alert, a visual alert, or a combination thereof.

A determination is then made at 420 whether another action to be performed by the door 130-132 is required. For example, a determination is made whether some input has been received indicating a further action is to be undertaken, whether another door need now be opened after another door closed, whether the opened door needs to now be closed, etc. Upon a positive determination, operations proceed to 510 of FIG. 5 as discussed in greater detail below. Upon a negative determination at 420, operations with respect to FIG. 4 terminate.

Referring now to FIG. 5, operations begin at 502 with the receipt of a command input. It will be appreciated that such a command input may correspond to user input via the user device 124, via automatic sensing of equipment/miners/vehicles (via the sensor data 154 received at 402), via detection by a pressure sensitive switch, via actuation by a user at the door, or the like. Upon receipt of a command input, a determination is made at 504 whether a predefined operation 114 has been initiated. That is, whether a series or set of predefined actions 116 has been initiated, e.g., operation of an air-lock, an emergency opening of all ventilation shafts, etc. Upon a negative determination at 504, operations proceed to 506, whereupon a control command 156 to initiate a predefined action is communicated to the drive components 146 of the door 130-134 in accordance with the received command input, e.g., open door, close door, etc., operations then return to 402 of FIG. 4.

When it is determined at 504 that the command input corresponds to a predefined operation, flow proceeds to 508, whereupon the predefined operations component 114 retrieves a set of actions from the predefined action component 116 associated with the selected operation. At 510, an action to be performed in accordance with the operation is selected via the predefined operations component 114, whereupon a control command 156 is communicated to the drive components 146 associated with the door 130-134 to initiate the action at 506 and operations return to 402 at FIG. 4 as set forth in greater detail above. As referenced above, when a determination is made at 420 that another action is to be performed, operations proceed to 510 for the selection of the next action by the predefined operations component 114 and initiation thereof at 506.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

What is claimed is:

1. A mine door control system, comprising:

a processor;

a sensor analysis component in communication with the processor, the sensor analysis component configured to receive sensor data from a plurality of sensors corresponding to operation of the at least one associated mine door;

memory in communication with the processor, the memory storing instructions which are executed by the processor for:

receiving sensor input from the plurality of sensors corresponding to at least one of a position of the at least one associated mine door and a path through the at least one associated mine door;

determining a predefined action in accordance with received sensor input; and operating at least one drive mechanism associated with the at least one associated mine door in accordance with the determined predefined action responsive to the received sensor input.

2. The mine door control system of claim 1, wherein the at least one associated mine door is an opposing wing mine door.

3. The mine door control system of claim 2, wherein the at least one associated mine door is configured at a 12-6 pitch orientation.

4. The mine door control system of claim 3, wherein the processor comprises a programmable logic controller.

5. The mine door control system of claim 3, further comprising at least one timer, the at least one timer configured to output a duration to the processor indicative of the at least one predefined action.

6. The mine door control system of claim 5, wherein the at least one predetermined action is selected from the group consisting of an opening, a closing, and a transiting corresponding to the at least one associated mine door.

7. The mine door control system of claim 6, wherein the memory further comprises instructions which are executed by the processor for communicating a control command to the drive mechanism of the at least one associated mine door, the control command including a predefined operation comprising a set of predefined actions.

8. The mine door control system of claim 7, wherein the memory further comprises instructions which are executed by the processor for:

receiving the duration output from the timer; and initiating at least one predefined action responsive with the received duration.

9. The mine door control system of claim 8, further comprising a notification component configured to generate at least one of an audible or visual indication of movement of the mine door.

10. The mine door control system of claim 9, wherein the visual indication is a color indicative of an opening or closing of the mine door.

11. The mine door control system of claim 10, wherein the sensor data includes data corresponding to an obstruction in the path, the memory further comprising instructions which are executed by the processor for:

halting movement of the wings of the at least one associated mine door; and generating a movement cessation notification via the notification component indicative of the halted movement.

12. A method for controlling operation of at least one associated mine door, comprising:

receiving sensor input from a plurality of sensors corresponding to at least one of a position of the at least one associated mine door and a path through the at least one associated mine door;

determining, with a processor, at least one predefined action in accordance with received sensor input;

communicating a control command to a drive mechanism associated with the at least one associated mine door, the control command including instructions for operating the drive mechanism in accordance with the at least one predefined action; and receiving sensor data from the plurality of sensors responsive to the performance of the at least one predefined action.

13. The method of claim 12, wherein the at least one associated mine door is an opposing wing mine door.

14. The method of claim 13, wherein the at least one associated mine door is configured at a 12-6 pitch orientation.

15. The method of claim 14, wherein the processor comprises a programmable logic controller.

16. The method of claim 15, further comprising timing a duration corresponding to the performance of the at least one predefined action.

17. The method of claim 16, further comprising initiating at least one additional predefined action in response to the received duration.

18. The method of claim 16, wherein the at least one predefined action is selected from the group consisting of an opening, a closing, and a transiting corresponding to the at least one associated mine door.

19. The method of claim 18, further comprising:

receiving a command input from an associated user, the command input including a predefined operation comprising a set of predefined actions; and communicating a series of control commands to the drive mechanism of the at least one associated mine door in accordance with the set of predefined actions.

20. The method of claim 18, further comprising generating at least one of an audible or visual indication of movement of the mine door.

21. The method of claim 20, wherein the sensor data includes data corresponding to an obstruction in the path, further comprising:

halting movement of the wings of the at least one associated mine door; and generating a movement cessation notification via the notification component indicative of the halted movement.

22. A mine door control system, comprising:

a processor;

memory in communication with the processor;

at least one drive mechanism configured to open and close at least one associated mine door; and a plurality of sensors configured to provide input to the processor corresponding to operation of the at least one associated mine door;

wherein the memory stores instructions which are executed by the processor for:

receiving sensor input from the plurality of sensors corresponding to at least one of a position of the mine door; and operating the at least one drive mechanism in accordance with received sensor input.

* * * * *